US008047334B2

(12) United States Patent
Christy et al.

(10) Patent No.: US 8,047,334 B2
(45) Date of Patent: Nov. 1, 2011

(54) DESTINATION ENTRY GROUP ELEVATOR SYSTEM FOR FACILITATING TRANSPORT OF LARGE ITEMS

(75) Inventors: Theresa M. Christy, West Hartford, CT (US); Anne R. L. Davis, Middlefield, CT (US); Jannah A. Stanley, Cromwell, CT (US)

(73) Assignee: Otis Elevator Company, Farmington, CT (US)

( * ) Notice: Subject to any disclaimer, the term of this patent is extended or adjusted under 35 U.S.C. 154(b) by 443 days.

(21) Appl. No.: 12/226,553

(22) PCT Filed: Apr. 27, 2006

(86) PCT No.: PCT/US2006/016119

§ 371 (c)(1),
(2), (4) Date: Feb. 9, 2009

(87) PCT Pub. No.: WO2007/130009

PCT Pub. Date: Nov. 15, 2007

(65) Prior Publication Data

US 2009/0308695 A1 Dec. 17, 2009

(51) Int. Cl.
*B66B 1/20* (2006.01)

(52) U.S. Cl. ..... 187/384; 187/392

(58) Field of Classification Search ..... 187/247, 187/380–388, 391–396
See application file for complete search history.

(56) References Cited

U.S. PATENT DOCUMENTS

| | | | | |
|---|---|---|---|---|
| 4,298,100 | A | 11/1981 | Süss et al. | |
| 5,689,094 | A * | 11/1997 | Friedli et al. | 187/384 |
| 5,932,853 | A * | 8/1999 | Friedli et al. | 187/392 |
| 6,382,363 | B1 * | 5/2002 | Friedli | 187/384 |
| 6,425,460 | B2 * | 7/2002 | Schuster | 187/247 |
| 6,615,175 | B1 * | 9/2003 | Gazdzinski | 704/275 |
| 6,801,792 | B1 | 10/2004 | Schuster et al. | |
| 7,610,995 | B2 * | 11/2009 | Ylinen et al. | 187/382 |
| 7,712,586 | B2 * | 5/2010 | Legez | 187/391 |
| 7,882,938 | B2 * | 2/2011 | Blackaby et al. | 187/388 |
| 2001/0022252 | A1 | 9/2001 | Schuster | |
| 2008/0169159 | A1 * | 7/2008 | Finschi et al. | 187/383 |

* cited by examiner

*Primary Examiner* — Anthony Salata
(74) *Attorney, Agent, or Firm* — Kinney & Lange, P.A.

(57) ABSTRACT

Elevators (104) in a group elevator system (100) are controlled to facilitate transport of a large item (LI). A destination entry input device receives an input from a passenger (102) indicating that the passenger (102) has a large item (LI) to be transported in the group elevator system (100). The passenger (102) with the large item (LI) is assigned to an elevator (104) having capacity to accommodate the passenger (102) and the large item (LI).

19 Claims, 4 Drawing Sheets

DESTINATION ENTRY GROUP ELEVATOR SYSTEM FOR FACILITATING TRANSPORT OF LARGE ITEMS

BACKGROUND OF THE INVENTION

The present invention relates to the field of elevator control, and in particular to control of a group elevator system to facilitate transporting of a large item.

Conventional group elevator systems include hall call modules near the elevators on each floor. Typically, the hall call modules include up and down buttons that are pressed by passengers when elevator service is desired. Each hall call module is assigned a network address that an elevator controller uses to associate the hall call module with its floor location. When one of the buttons on the hall call module is pressed, the elevator controller assigns an elevator that will most efficiently deliver the passengers in the desired direction. The elevator controller determines which floor to send an elevator to based on the network address of the hall call module on which a button was pressed.

Recently, elevator systems with destination entry have been introduced. In a destination entry system, passengers register their destination floors on a destination entry input device before a car is assigned. The group elevator system assigns each passenger to an elevator that most efficiently transports him or her to the desired destination floor. Passengers register their destination floors on destination entry devices, which may take the form of a numeric keypad or a touch screen display.

Large items to be transported between floors in an elevator can consume much of the volume or use a substantial portion of the maximum rated load for the elevator car. This may disrupt efficient transport of passengers and other loads in a group elevator system, since the elevator controller may be unable to determine that a passenger making a dispatch request is accompanied by a large item. For example, in a destination entry type system, when a passenger with a large item enters his or her destination floor, the controller may assign the passenger to an elevator that already includes a large number of people. Similarly, when a passenger with the large load is assigned to an empty or nearly empty elevator, the controller may subsequently assign additional passengers to the elevator. These circumstances may result in overcrowding or overloading of the elevator car, or passengers may be required to re-enter their destination and wait for a different elevator.

BRIEF SUMMARY OF THE INVENTION

The subject invention is directed to controlling elevators in a group elevator system to facilitate transport of a large item. A destination entry input device receives an input from the passenger indicating that the passenger has a large item to be transported in the group elevator system. The passenger with the large item is then assigned to an elevator having capacity to accommodate the passenger and the large item.

DETAILED DESCRIPTION

Figure 1:
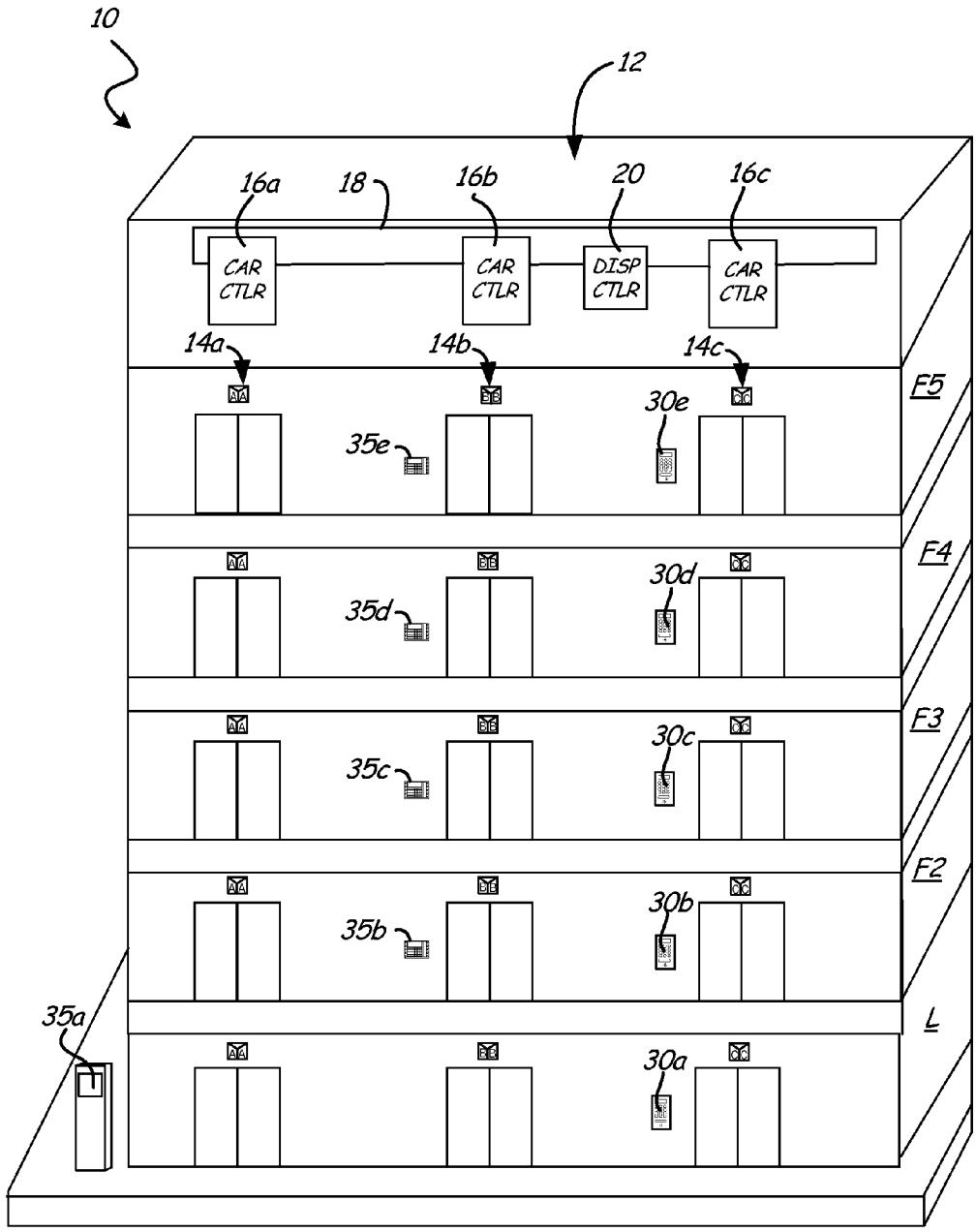
FIG. 1 is a perspective view of a destination entry group elevator system.

FIG. 1 is a perspective view of destination entry based elevator system 10 in building 12. Building 12 includes five floors, including lobby floor L, second floor F2, third floor F3, fourth floor F4, and fifth floor F5. Group elevator system 10 includes three elevators 14*a*, 14*b*, and 14*c*, each of which is operable to transport passengers to any of the floors in building 12. While three elevators 14*a*-14*c* and five floors L and F2-F5 are shown, it will be appreciated that the present invention is applicable to destination entry group elevator systems with any number of elevators servicing any number of floors.

The operation of each elevator is controlled by a dedicated car controller. In particular, elevator 14*a* is controlled by car controller 16*a*, elevator 14*b* is controlled by car controller 16*b*, and elevator 14*c* is controlled by car controller 16*c*. Car controllers 16*a*-16*c* are connected to and communicate with each other via communications loop 18.

Car controllers 16*a*-16*c* control elevators 14*a*-14*c*, respectively, based on elevator control information received from dispatch controller 20. Dispatch controller 20 is connected to car controllers 16*a*-16*c* via communications loop 18. Dispatch controller 20 processes destination input information received via communications lines (not shown) and provides elevator control information based, in part, on the destination input information.

Destination input information is provided by passengers via destination entry input devices. The destination entry input devices may be located next to the elevators on each floor, which are used by passengers to enter their desired destination floor via numbered keys on the input device. Alternatively, the destination entry input devices may be provided on less than all floors, with two-button hall call modules provided on the remaining floors. The destination entry input devices may also include keys labeled for specific areas of the building such that a passenger may press the labeled keys to be transported directly to the area on the key. In addition, the destination entry input devices may include a dedicated button for each floor in the building.

Alternatively, the destination entry input device may comprise a device that receives the destination input information from an item or device that is carried by the passenger. For example, the destination entry input device may include a security card reader, which allows a passenger to register destination input information by passing a security card (which includes stored information about the passenger's destination floor) through the security card reader. The destination entry input device may also include a electric transducer or receiver, which receives a signal related to the passenger's destination floor from a transmitter carried by the passenger.

In group elevator system 10, the destination entry input devices include keypads 30*a*, 30*b*, 30*c*, 30*d*, and 30*e*, and touch screen displays 35*a*, 35*b*, 35*c*, 35*d*, and 35*e*, together with digital circuitry that facilitates communication between the destination entry input devices and dispatch controller 20. Keypads 30 will be described in more detail with regard to FIG. 2, and touch screen display 35 will be described in more detail with regard to FIG. 3. The digital circuitry associated with each keypad 30 and touch screen display 35 is connected to dispatch controller 20 via a data line (not shown). The use of keypads 30 and touch screen displays 35 to facilitate transport of a large item will be described with regard to FIG. 4. It will be appreciated that any combination of keypads 30 and touch screen displays 35, as well as two-button hall call modules, may be employed throughout building 12.

The scheduling of elevators 14*a*-14*c* is coordinated by dispatch controller 20 based, in part, on the destination input information provided on keypads 30 and touch screen displays 35. Elevators 14*a*-14*c* are independent, but are coupled through serving a common pool of passengers. For each passenger, there is only one elevator 14 that will serve that passenger. As each passenger enters his or her destination floor on one of keypads 30 or touch screen displays 35, the passenger is directed to an elevator that will most efficiently service his or her destination request. Dispatch controller 20 communicates with car controllers 16*a*-16*c* to determine operational properties (e.g., location, door position state, etc.) of elevators 14*a*-14*c* when assigning passengers to an elevator. When passengers enter their assigned elevator, the car controller controls the elevator so as to stop at those floors that passengers on the assigned elevator requested, and those floors that the assigned elevator has been committed by dispatch controller 20 to pick up additional passengers. By grouping passengers in this way, passengers reach their destination floor in an efficient manner with fewer stops than in conventional elevator systems.

Figure 2:
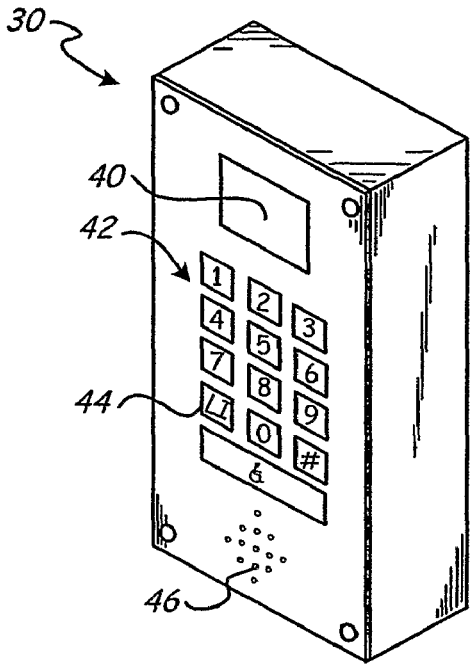
FIG. 2 is a perspective view of a keypad used in the destination entry group elevator system shown in FIG. 1.

FIG. 2 is a perspective view of keypad 30 used in the destination entry group elevator system 10 shown in FIG. 1. Keypad 30 includes display 40, keys 42 including large item (LI) key 44, and electroacoustic transducer or speaker 46. In one embodiment, display 40 is a liquid crystal display (LCD) or light-emitting diode (LED) type display.

Figure 3:
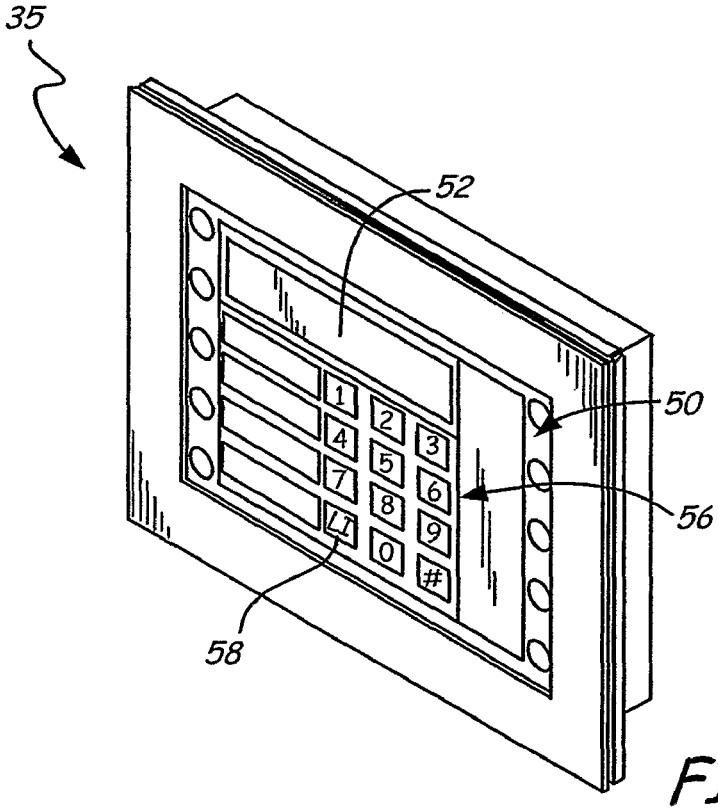
FIG. 3 is a perspective view of a touch screen display used in the destination entry group elevator system shown in FIG. 1.

FIG. 3 is a perspective view of a touch screen display 35 used in the destination entry group elevator system 10 shown in FIG. 1. Touch screen display 35 includes screen 50 for displaying various interactive keys for use by passengers to operate group elevator system 10. The information provided on screen 50 is customizable to the building in which it is provided. In the embodiment shown, screen 50 includes active display 52 and keys 56 including large item (LI) key 58.

The passenger interface and the function of keypad 30 and touch screen display 35 are similar, and thus will be described concurrently. When a passenger wishes to be transported between floors in group elevator system 10, the passenger may enter his or her desired destination floor using keys 42 on keypad 30 or keys 56 on touch screen display 35. For example, if a passenger wants to be transported from lobby floor L to floor F4, the passenger presses the "4" key on either keypad 30*a* or touch screen display 35*a* located on lobby floor L. This destination input information is provided to dispatch controller 20 by the destination entry input device.

After receiving the destination input information, dispatch controller 20 determines the locations of the cars in elevators 14*a*-14*c* based on information provided by car controllers 16*a*-16*c*, and assigns the passenger to one of elevators 14*a*-14*c* that most efficiently transports all passengers to the desired destination floor. Dispatch controller 20 provides a signal to the destination entry input device (i.e., keypad 30 or touch screen display 35) that was used by the passenger to enter the destination input information, which may then communicate the elevator assignment to the passenger. The elevator assignment information may be provided by keypad 30 via display 40 and/or electroacoustic transducer 46, or by touch screen display 35 via screen 50. For example, if the passenger uses keypad 30*a* proximate to elevator 14*c* to enter the destination input information, and the passenger is assigned to elevator 14*a* by dispatch controller 20, the letter "A" appears on display 40. An arrow or other directional symbol may also be displayed on display 40 to guide the passenger in the direction of the assigned elevator.

When a passenger wants to transport a large item (i.e., a high volume or high weight item) between floors in group elevator system 10, dispatch controller 20 checks the status of all elevators and assigns an elevator with sufficient available space and carrying capacity to accommodate the passenger with the large item. In addition, dispatch controller 20 limits the number of passengers assigned to the elevator transporting the passenger with the large item until the passenger with the large item reaches the destination floor.

Figure 4:
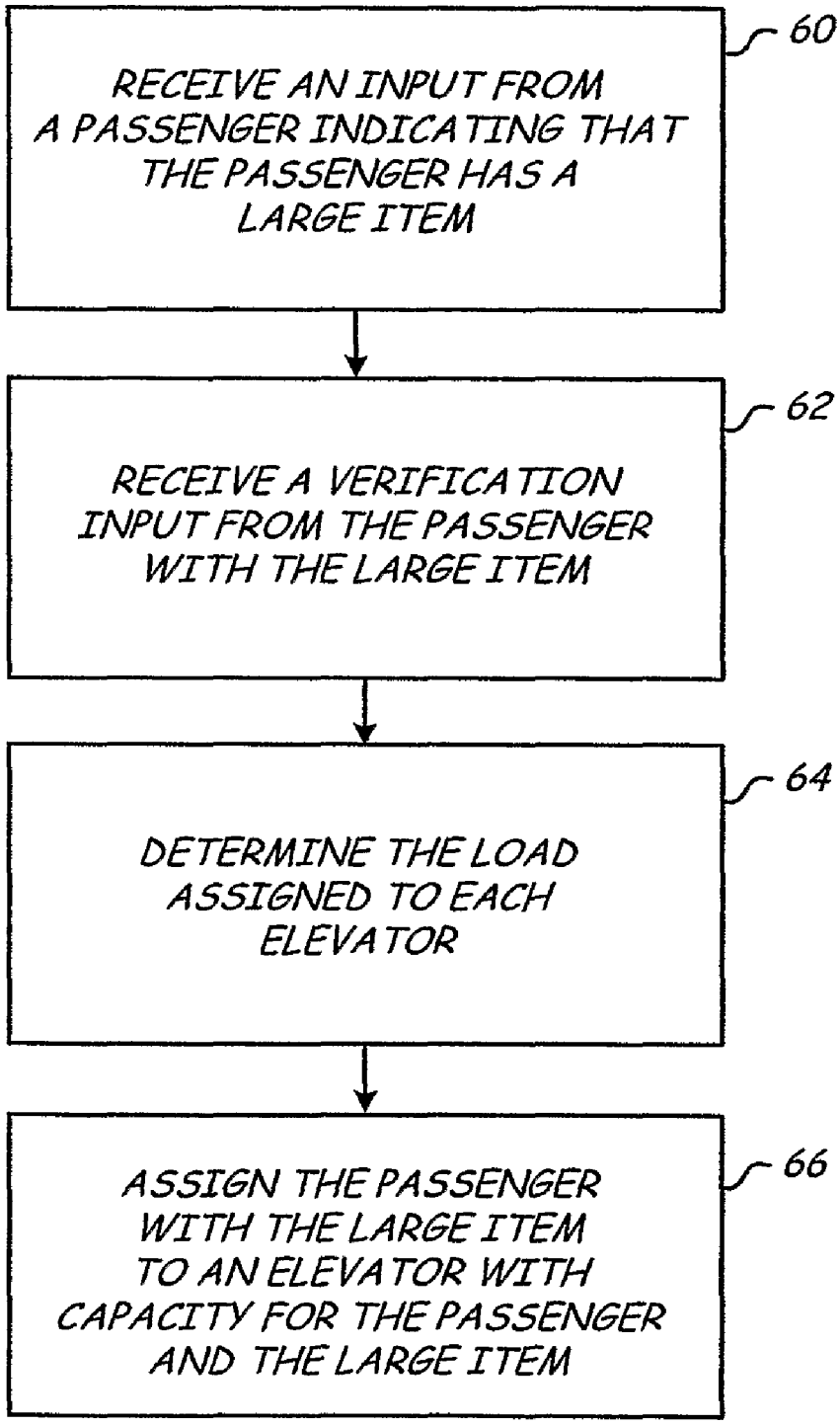
FIG. 4 is a flow diagram for a process of controlling elevators in a group elevator system to facilitate transport of a large item.

FIG. 4 is a flow diagram for a process of controlling elevators 14*a*-14*c* in group elevator system 10 to facilitate transport of a large item. To begin, an input is provided by a passenger with the large item indicating that the passenger wants to transport the large item in group elevator system 10. This input, which is received by dispatch controller 20 (step 60), may be provided by pressing a dedicated key on a destination entry input device (e.g., LI key 44 on one of keypads 30 or LI key 58 on one of touch screens 35). After pressing the large item key on a destination entry input device, the passenger with the large item may be prompted on the destination entry input device as described above to enter his or her destination floor on the destination entry input device.

When the large item key is pressed by the passenger with the large item, the passenger may optionally be prompted to provide a verification input. The verification input, which is received by dispatch controller 20 (step 62), may be used to prevent abuse or misuse of the large item transport request. For example, the passenger may be required to enter a numeric verification code on keys 42 or 56 to establish that the passenger is authorized to call a dedicated elevator for moving the large item. The passenger may alternatively be required to swipe a security card or actuate a key switch with a key for authorization. If the verification input is not provided or is provided incorrectly, the large item transport request is disregarded by dispatch controller 20.

Dispatch controller 20 then determines the load already assigned to each elevator 14*a*-14*c* (step 64). In particular, dispatch controller 20 determines the number of passengers assigned to each elevator 14*a*-14*c* when the large item transport request is made. For example, dispatch controller 20 may determine the number of passengers assigned to each elevator 14*a*-14*c* by tracking all passengers in the system through each passenger's origin and destination floor. In group elevator system 10 including a destination entry input device at every floor, dispatch controller 20 can track all passengers in the elevator system by storing each passenger's registered destination floor and the origin floor on which each passenger registered the destination floor. In a mixed configuration group elevator system (i.e., a group elevator system including both destination entry input devices and two-button hall call modules), dispatch controller 20 may estimate the number of passengers by associating each call from a two-button hall call module with a single passenger. This estimate may be adjusted by measuring changes in load weight as determined by, for example, load weight sensors associated with each elevator.

Dispatch controller 20 uses the assigned load information to assign one of elevators 14*a*-14*c* that has capacity (i.e., sufficient available volume and weight) to accommodate the large item (step 66). In one embodiment, dispatch controller 20 assigns the passenger with the large item to an elevator that will be empty or nearly empty when the elevator arrives at the origin floor of the passenger with the large item. This not only prevents overcrowding or overloading of the elevator assigned to the passenger with the large item, but also avoids repeat service requests by the passenger to find an elevator with sufficient capacity to accommodate the passenger and the large item.

Dispatch controller 20 also limits the number of passengers subsequently assigned to the elevator assigned to the passenger with the large item until the passenger with the large item reaches the destination floor. This avoids the possibility of passengers being assigned to an elevator that has limited capacity due to being assigned to the large item.

Figure 5:
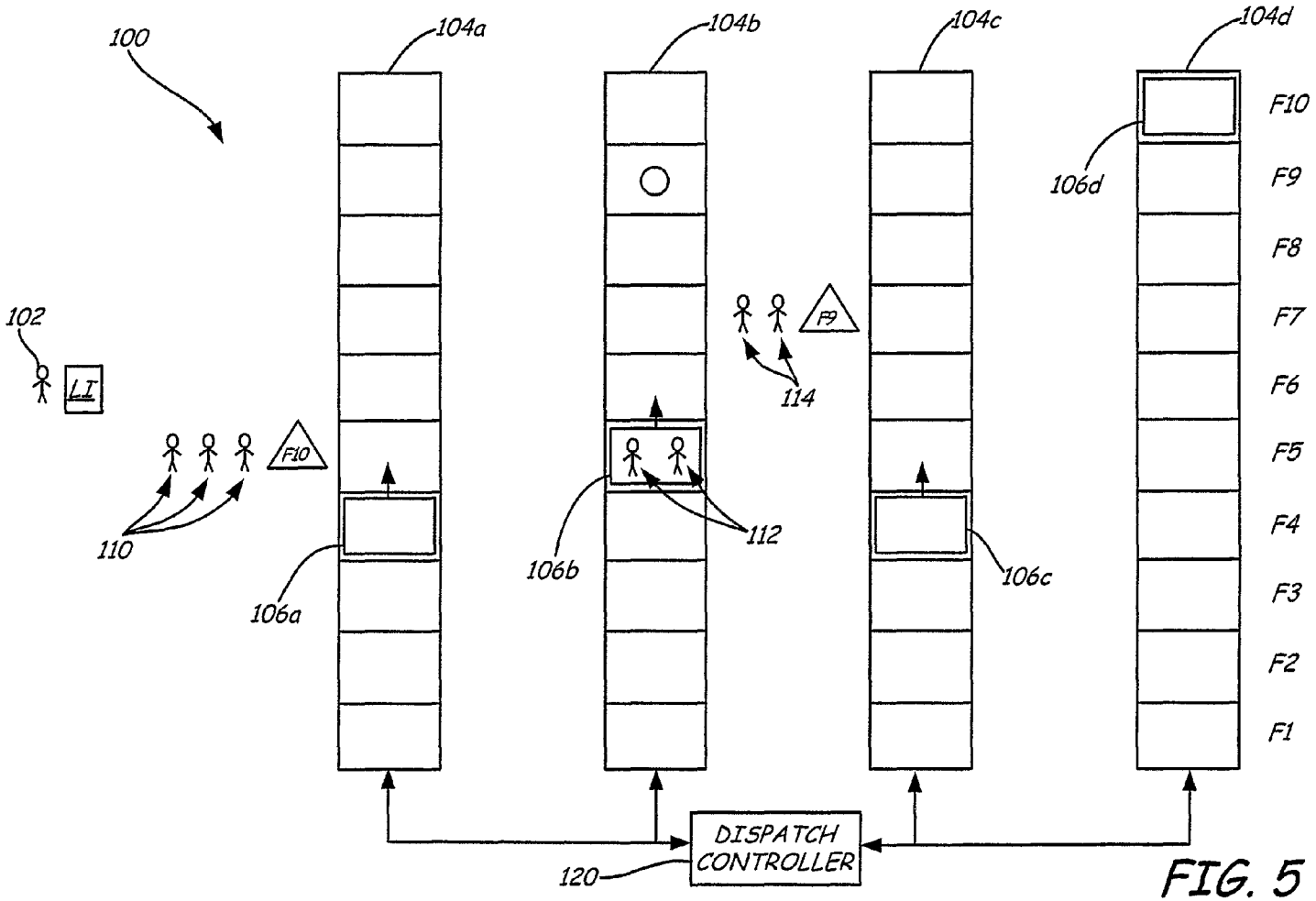
FIG. 5 is a schematic view of a group elevator system showing the process of assigning a passenger with a large item to an elevator in the group elevator system.

FIG. 5 is a schematic view of a group elevator system 100 that illustrates the process of assigning a passenger 102 with a large item LI to an elevator in the group elevator system. Group elevator system 100 includes elevators 104*a*, 104*b*, 104*c*, and 104*d* including elevator cars 106*a*, 106*b*, 106*c*, and 106*d*, respectively. Elevator cars 106*a*-106*d* each service floors F1-F10. Dispatch controller 120, which has a similar function as dispatch controller 20 in FIG. 1, processes destination input information and provides elevator control information based on the destination input information. It should be noted that while a single elevator car 106 is shown associated with each elevator 104, any of elevators 104 may also include multiple elevator cars.

When passenger 102 presses the large item key on a destination entry input device (i.e., keypad 30 or touch screen display 35), dispatch controller 120 is alerted that a passenger on floor F6 wants to transport a large item. The destination entry input device then optionally prompts passenger 102 for a verification input. Subsequently, the destination entry input device prompts passenger 102 for a destination floor for passenger 102 and large item LI. For example, passenger 102 may wish to go to floor F8, and thus presses the "8" key on the destination entry input device.

When dispatch controller 120 receives information that there is a passenger with a large item on floor F6 who wants to be transported to floor F8, dispatch controller 120 evaluates each elevator car 106 with respect to assigned load, location, and direction of movement to determine which elevator car 106 should be assigned to the passenger with the large item. Dispatch controller 120 determines the number of stops each elevator car 106 must make to transport passengers in each car to their respective destination floors, as well as the number of stops each elevator car 106 must make to transport passengers assigned to, but not yet on, each car. In addition, dispatch controller 120 establishes the number of passengers that would be in each car for the entire trip if the car were assigned to transport passenger 102 and large item LI. To prevent overcrowding or overloading, this number may be compared to a configurable limit such that, if the number of passengers is greater than the configurable limit, the car is considered ineligible for assignment to passenger 102 and large item LI.

Dispatch controller 120 then assigns an elevator car 106 that is eligible to accommodate passenger 102 and large item LI. If there are multiple eligible elevator cars 106, dispatch controller 120 assigns the elevator car that has the least number of other passengers assigned to it and that can most efficiently transport the passenger with the large item. If there are no eligible elevator cars 106, dispatch controller 120 will assign the passenger with the large item to the elevator car that will empty first (based on existing demand). Dispatch controller 120 will not assign additional passengers to this elevator car prior to transporting the passenger with the large item.

To illustrate, in group elevator system 100, elevator car 106*a* is assigned to transport passengers 110 from floor F5 to floor F10. As a result, by the time elevator car 106*a* reaches floor F6 (the location of passenger 102 and large item LI), elevator car will already be transporting passengers 110. Elevator car 106*b* is located at floor F5 and, while it is nearest to the location of passenger 102 and large item LI (level L6), it is assigned to passengers 112 and is transporting them to destination floor F9. Elevator car 106*c* is empty, but has been assigned to pick up passengers 114 at floor F7 and transport them to destination floor F9. If elevator car 106*c* was also assigned to passenger 102 and large item LI, passengers 114 would be picked up after passenger 102 and large item LI. Finally, elevator car 106*d* is empty and has not been assigned to any other passengers.

Dispatch controller 120, which monitors the number of passengers assigned to each elevator, then determines which elevators are eligible to transport passenger 102 and large item LI. If the configurable limit for additional passengers allowed in an elevator car with passenger 102 with large item LI is set to, for example, no other passengers or one other passenger, then elevator car 106*d* is the only eligible elevator car. If the configurable limit is set to a higher number of passengers, then multiple elevator cars 106 are eligible to transport passenger 102 and large item LI. However, because elevator car 106*d* has the least number of other assigned passengers, elevator car 106*d* is the preferred elevator among the eligible elevator cars 106. Consequently, elevator car 106*d* is the best candidate in elevator system 100 for transporting passenger 102 and large item LI from origin floor F6 to destination floor F8.

Dispatch controller 120 then assigns passenger 102 and large item LI to elevator car 106*d*. If additional passengers are on floor F6 with passenger 102 and large item LI, dispatch controller 120 may assign any of elevator cars 106*a*, 106*b*, or 106*c* to transport these additional passengers to their destination floor. As a result, passenger 102 and large item LI are assigned to an empty or nearly empty elevator for transport between floors.

In summary, the subject invention is directed to controlling elevators in a group elevator system to facilitate transport of a large item. A destination entry input device receives an input from the passenger indicating that the passenger has a large item to be transported in the group elevator system. The passenger with the large item is then assigned to an elevator having capacity to accommodate the passenger and the large item. When a dispatch controller in a group elevator system is alerted in advance that a passenger has a large item, the dispatch controller can assign the passenger with the large item to an elevator with few or no other passengers, which prevents overcrowding and overloading. In addition, passenger inconvenience is reduced because the dispatch controller limits the number of passengers assigned to an elevator that has been assigned to the passenger with the large item.

Although the present invention has been described with reference to examples and preferred embodiments, workers skilled in the art will recognize that changes may be made in form and detail without departing from the spirit and scope of the invention.

The invention claimed is:

1. A method for controlling elevators in a group elevator system, the method comprising:

receiving an input from a passenger on a destination entry input device indicating that the passenger has a large item to be transported in the group elevator system;

receiving a destination floor input from the passenger on the destination entry device indicating a destination floor for the large item; and assigning the passenger with the large item to an elevator with capacity to accommodate the passenger and the large item based upon the inputs from the passenger on the destination entry input device.

2. The method of claim 1, wherein the assigning step comprises:

determining a number of passengers assigned to each elevator in the group elevator system; and assigning the passenger with the large item to a nearest elevator with less than a threshold number of assigned passengers.

3. The method of claim 1, and further comprising:

limiting a number of passengers that are assigned to the elevator assigned to the passenger with the large item until the passenger with the large item reaches a destination floor.

4. The method of claim 1, wherein the receiving step comprises:

receiving a signal when a large item key on the destination entry input device is pressed by the passenger.

5. The method of claim 1, wherein the receiving step comprises:

receiving a validation code input on the destination entry input device from the passenger.

6. A system comprising:

a group of elevators operable to transport each of a plurality of passengers to one of a plurality of floors;

a destination entry input device on at least one floor that provides an interface for each passenger to input a destination floor, wherein the destination entry input device includes a large item key for use by a passenger having a large item to be transported in one of the elevators; and a dispatch controller for assigning an elevator to each passenger based on the destination input information and for assigning a passenger with a large item who presses the large item key to a nearest elevator having capacity to accommodate the passenger and the large item.

7. The system of claim 6, wherein the dispatch controller determines a number of passengers assigned to each elevator in the group elevator system and assigns the passenger with the large item to an elevator with no other passengers assigned to the elevator.

8. The system of claim 6, and further comprising:

a validation device that facilitates a validation action by the passenger subsequent to pressing the large item key to prevent misuse of the large item key.

9. The system of claim 8, wherein the validation device comprises a keypad on the destination entry input device to facilitate entering a validation code.

10. The system of claim 8, wherein the validation device comprises a key reader to facilitate use of a validation key by the passenger.

11. The system of claim 6, wherein the destination entry input device includes a communication device selected from the group consisting of a display and an acoustic transducer.

12. A method for facilitating transport of a large item in a group elevator system, the method comprising:

receiving a first input indicating an origin floor of the large item in the group elevator system;

receiving a second input indicating a destination floor of the large item in the group elevator system;

determining status information for each elevator in the group elevator system; and assigning the large item to an elevator having capacity to accommodate the passenger and the large item.

13. The method of claim 12, and further comprising: dispatching the assigned elevator to the origin floor.

14. The method of claim 12, and further comprising: limiting loads subsequently assigned to the elevator that is assigned to the large item until the large item reaches the destination floor.

15. The method of claim 12, wherein the assigning step comprises: assigning the large item to an elevator with less than a threshold assigned load.

16. The method of claim 12, wherein the first input and the second input are received on a destination entry input device.

17. The method of claim 16, wherein receiving the first input comprises: receiving a signal when a large item key on the destination entry input device is pressed.

18. The method of claim 16, wherein receiving the first input comprises: receiving a validation code input on the destination entry input device.

19. The method of claim 12, wherein the determining step comprises: determining a location of each elevator and a load assigned to each elevator in the group elevator system.

* * * * *